US012736263B2

(12) United States Patent
Brownfield et al.

(10) Patent No.: US 12,736,263 B2
(45) Date of Patent: Sep. 15, 2026

(54) TWIST TRAY ICE MAKING SYSTEM WITH SLANTED BRIDGING

(71) Applicants: BSH Home Appliances Corporation, Irvine, CA (US); BSH Hausgeräte GmbH, Munich (DE)

(72) Inventors: Caleb Brownfield, Knoxville, TN (US); Nilton Bertolini, Clinton, TN (US); Conner Wainauski, Knoxville, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 250 days.

(21) Appl. No.: 18/377,366

(22) Filed: Oct. 6, 2023

(65) Prior Publication Data

US 2025/0116446 A1 Apr. 10, 2025

(51) Int. Cl.
*F25C 1/10* (2006.01)
*F25C 1/22* (2018.01)

(52) U.S. Cl.
CPC ..... *F25C 1/10* (2013.01); *F25C 1/22* (2013.01); *F25C 2400/10* (2013.01); *F25C 2700/14* (2013.01)

(58) Field of Classification Search
CPC ..... F25C 1/10; F25C 1/22; F25C 2400/10; F25C 2700/14; F25C 2500/02; F25C 2700/12
USPC ..... 62/340
See application file for complete search history.

(56) References Cited

U.S. PATENT DOCUMENTS 2,481,525 A * 9/1949 Mott ..... F25C 1/243 249/127
2,785,538 A * 3/1957 Schweller et al. ..... F25D 23/04 62/344
2,941,379 A * 6/1960 Nelson ..... F25C 1/10 318/473

(Continued)

FOREIGN PATENT DOCUMENTS

EP 2660541 A2 * 11/2013 ..... F25C 5/06
EP 2778573 A2 * 9/2014 ..... F25C 1/243

(Continued)

OTHER PUBLICATIONS

JP-H08296933-A, machine translation (Year: 2025).*

(Continued)

*Primary Examiner* — Eric S Ruppert
*Assistant Examiner* — Kirstin U Oswald
(74) *Attorney, Agent, or Firm* — Michael E. Tschupp; Andre Pallapies; Brandon G. Braun

(57) ABSTRACT

A twistable ice cube tray in an automatic ice-making system of a refrigeration appliance can produce small, chewable ice cubes. The twistable ice cube tray can receive water from a water filling system at a first end of the twistable ice cube tray. The twistable ice cube tray can include ice cavities for freezing the water into ice cubes having a mass of up to 1.5 grams. The twistable ice cube tray can also include slanted bridges, with each slanted bridge positioned between adjacent ice cavities. The slanted bridges can transfer the water from a first set of compartments at the first end to a second set of compartments at a second end of the twistable ice cube tray that is opposite the first end.

20 Claims, 11 Drawing Sheets

(56) References Cited

U.S. PATENT DOCUMENTS

| | | | | | |
|---|---|---|---|---|---|
| 2,957,604 | A * | 10/1960 | Goldman | F25C 5/20 | 221/277 |
| 3,120,112 | A | 2/1964 | Davis | | |
| 3,217,508 | A * | 11/1965 | Beck | F25C 1/04 | 249/127 |
| 3,677,030 | A * | 7/1972 | Nicholas | F25C 1/04 | 62/353 |
| 3,763,662 | A * | 10/1973 | Nichols | F25C 1/24 | 425/440 |
| 4,142,377 | A | 3/1979 | Fogt | | |
| 4,265,089 | A | 5/1981 | Webb | | |
| 4,306,423 | A * | 12/1981 | Webb | F25C 1/24 | 62/72 |
| 5,182,916 | A * | 2/1993 | Oike | F25C 1/20 | 62/353 |
| 5,769,541 | A * | 6/1998 | Lee | G01K 1/14 | 374/150 |
| 9,032,746 | B2 | 5/2015 | Ito et al. | | |
| 10,753,665 | B2 | 8/2020 | Saito et al. | | |
| 11,035,601 | B2 | 6/2021 | Jeong et al. | | |
| 11,448,447 | B2 | 9/2022 | Bertolini et al. | | |
| 11,525,613 | B2 | 12/2022 | Hayashi | | |
| 2006/0032262 | A1* | 2/2006 | Seo | F25C 5/06 | 62/340 |
| 2007/0089441 | A1* | 4/2007 | Ito | F25C 1/22 | 62/340 |
| 2007/0209381 | A1* | 9/2007 | Sugaya | F25C 5/06 | 62/340 |
| 2010/0064716 | A1 | 3/2010 | Park | | |
| 2012/0102997 | A1* | 5/2012 | Oh | F25C 5/06 | 62/340 |
| 2017/0191722 | A1* | 7/2017 | Bertolini | F25C 5/22 | |
| 2017/0299244 | A1* | 10/2017 | Alshourbagy | F25C 5/06 | |
| 2017/0314831 | A1 | 11/2017 | Dirnberger | | |
| 2020/0064043 | A1* | 2/2020 | Larson | F25C 5/08 | |
| 2021/0222936 | A1* | 7/2021 | Larson | F25C 1/24 | |
| 2022/0390162 | A1 | 12/2022 | Ogg | | |

FOREIGN PATENT DOCUMENTS

| | | | | |
|---|---|---|---|---|
| GB | 998056 | A * | 7/1965 | F25C 1/04 |
| JP | H0229571 | A * | 1/1990 | |
| JP | H06249557 | A * | 9/1994 | |
| JP | H08296933 | A * | 11/1996 | |
| JP | H09291 | U * | 5/1997 | |
| JP | H1183254 | A * | 3/1999 | |
| JP | 2000088410 | A * | 3/2000 | |
| JP | 2003279209 | A * | 10/2003 | |
| JP | 2003307374 | A * | 10/2003 | |
| JP | 2004293920 | A * | 10/2004 | |
| JP | 2005024172 | A * | 1/2005 | |
| JP | 2005351624 | A * | 12/2005 | |
| JP | 2006275510 | A * | 10/2006 | |

OTHER PUBLICATIONS

JP-2005351624-A, machine translation (Year: 2025).*
JP-2000088410-A, machine translation (Year: 2026).*
JP-2005024172-A, machine translation (Year: 2026).*
JPH1030864A, machine translation (Year: 2026).*

* cited by examiner

TWIST TRAY ICE MAKING SYSTEM WITH SLANTED BRIDGING

TECHNICAL FIELD

The present disclosure relates generally to refrigeration appliances and, more particularly (although not necessarily exclusively), to a twist tray ice making system with slanted bridging.

BACKGROUND

Refrigeration appliances, including combination refrigerator-freezer appliances and freezer-only refrigeration appliances, frequently include icemaker systems such as automatic ice makers that produce ice cubes in ice cube trays. Automatic ice makers can include trays with ice cavities defining cavities into which water can be deposited and frozen into ice cubes. After the ice cubes are frozen, an automatic ice maker can automatically eject the ice cubes from the tray, such as into a storage bin.

DETAILED DESCRIPTION

Figure 1:
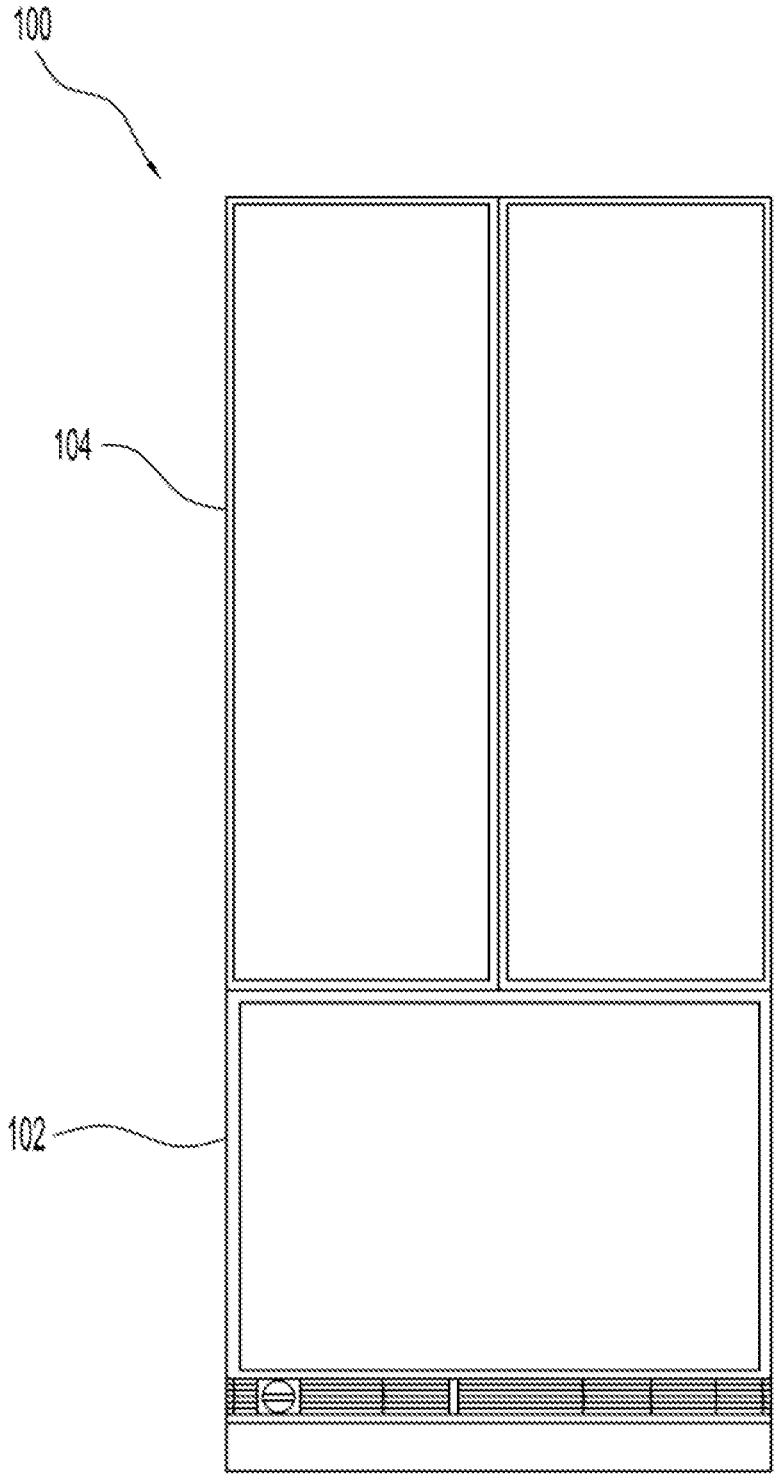
FIG. 1 depicts an example of a refrigeration appliance according to some embodiments of the present disclosure.

Certain aspects and examples of the present disclosure relate a twist tray ice making system with slanted bridging to produce small, chewable ice in a refrigeration appliance, which may be an ice-making refrigeration appliance having an automatic ice maker. More specifically, aspects and examples of the present disclosure are directed to a twistable ice tray in an automatic ice maker that includes slanted bridges between small individual ice cavities (e.g., compartments that can freeze ice into cubes of up to 1.5 grams). Such smaller ice cubes may be easier to chew due to a smaller size and mass than standard ice cubes, such as ice cubes with a mass of around 3 grams.

Many users prefer ice that is significantly smaller in size than a standard ice cube. It may be difficult to fill small ice cavities of an ice cube tray that can produce such small ice cubes with water. In particular, the small size of individual ice cavities can cause difficulties in spreading water deposited at one end of an ice cube tray all the way to the other end due to surface tension. If water is not evenly distributed between all ice cavities, some ice cavities may be overfilled. As water expands when frozen into ice, such overfilling can cause a slab of ice to form above the ice cavities that may be difficult or impossible to break into individual ice cubes. Further, the reduced surface area of small ice cavities and increased exposure to air flow can prevent a thermistor placed beneath the ice cube tray from taking an accurate temperature measurement of the water in the ice cavities.

Embodiments of the present disclosure can solve one or more of the abovementioned problems through use of the slanted bridges between ice cavities. For example, the slanted bridges (e.g., channels) can connect each ice cavity to an adjacent ice cavity. The slanted bridges can have a downward slope from the area of water fill in the ice cube tray. Some slanted bridges may also have a downward slope from the center of the ice cube tray to the edges of the ice cube tray. This slope can allow the leading edge of the water to break its surface tension in an ice cavity, causing the excess water to pour into the adjacent ice cavities and preventing formation of a slab above the ice cube tray. The water transference can continue until all the ice cavities in the ice tray have evenly filled with enough water to produce individual ice cubes of up to 1.5 grams. Such small ice cubes may be enjoyable for a user to chew and consume.

Further, a thermistor can be placed on a bottom side of the ice cube tray and on an opposite end from the water fill point. The thermistor can be placed in a pocket of modified ice cavities to increase thermistor contact with the ice cube tray. For example, a cylindrical thermistor may be placed in a round pocket between the underside of multiple (e.g., four) ice cavities. This thermistor position can allow the automatic ice maker to accurately detect the phase change from water to ice, keeping out confounding noise (e.g., from air flow produced by a fan) beneath the ice cube tray. The slanted bridges surrounding the thermistor can also aid in shielding the thermistor from air flow.

Although pieces of ice produced by the automatic ice maker described herein are referred to as "ice cubes," it is to be understood that this can refer to other shapes of ice beyond cuboid shapes. For example, ice cubes may be produced in accordion shapes, button shapes, conical shapes, round dimple shapes, donut shapes, square shapes, pyramid shapes, bar shapes, or any other suitable shape.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 depicts an example of a refrigeration appliance 100 according to some embodiments of the present disclosure. The refrigeration appliance can be a freezer or a combination refrigerator and freezer. For example, the refrigeration appliance 100 can include a first cabinet 102 defining a freezer space and a second cabinet 104 defining a refrigeration space. The first cabinet 102 and the second cabinet 104 may be arranged in various orientations, such as the first cabinet 102 positioned below the second cabinet 104 as depicted in FIG. 1. In another example, the first cabinet 102 may be positioned side by side or above the second cabinet 104, or in any other suitable arrangement. The first cabinet 102 may include an automatic ice maker, such as the automatic ice-making system 200 of FIG. 2.

Figure 2:
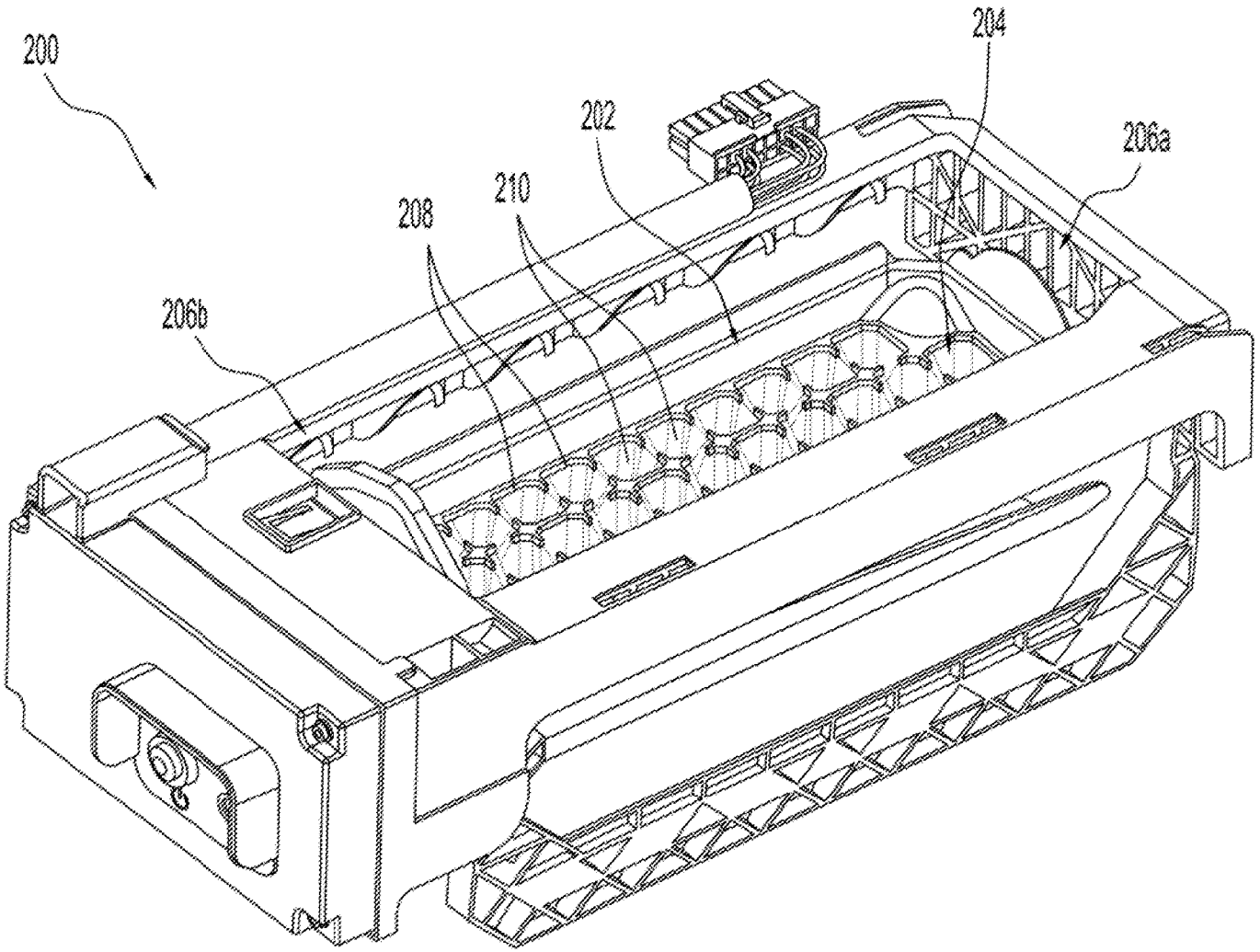
FIG. 2 depicts an example of automatic ice making system according to some embodiments of the present disclosure.

Turning now to FIG. 2, the automatic ice-making system 200 includes a twistable ice cube tray 202 that can be filled with water (e.g., by a water-filling system) at a fill point 204 at a first end 206*a* of the twistable ice cube tray 202. The water can propagate through ice cavities 208 from the first end 206*a* to the second end 206*b* via slanted bridges (not shown). The water may freeze into ice cubes 210 having a mass of up to 1.5 g each. For example, each ice cube 210 may have a mass 0.7 g, 0.8 g, 0.9 g, 1.0 g, 1.1 g, 1.2 g, 1.3 g, 1.4 g, or 1.5 g. After the water in the ice cavities 208 has frozen into ice cubes 210, the ice cubes 210 can be expelled from the twistable ice cube tray 202. The automatic ice-making system 200 can include a gear system (not shown) that couples to the second end 206*b* of the twistable ice cube tray 202 to rotate the second end 206*b*. The first end 206*a* of the twistable ice cube tray 202 can be partially or entirely prevented from rotating along with the second end 206*b*. This can cause the twistable ice cube tray 202 to twist, break the connecting portions of ice formed between the slanted bridges connecting the ice cavities 208, and expel the separated ice cubes 210 from the twistable ice cube tray 202 (e.g., into a storage bin positioned beneath the twistable ice cube tray 202).

Figure 3:
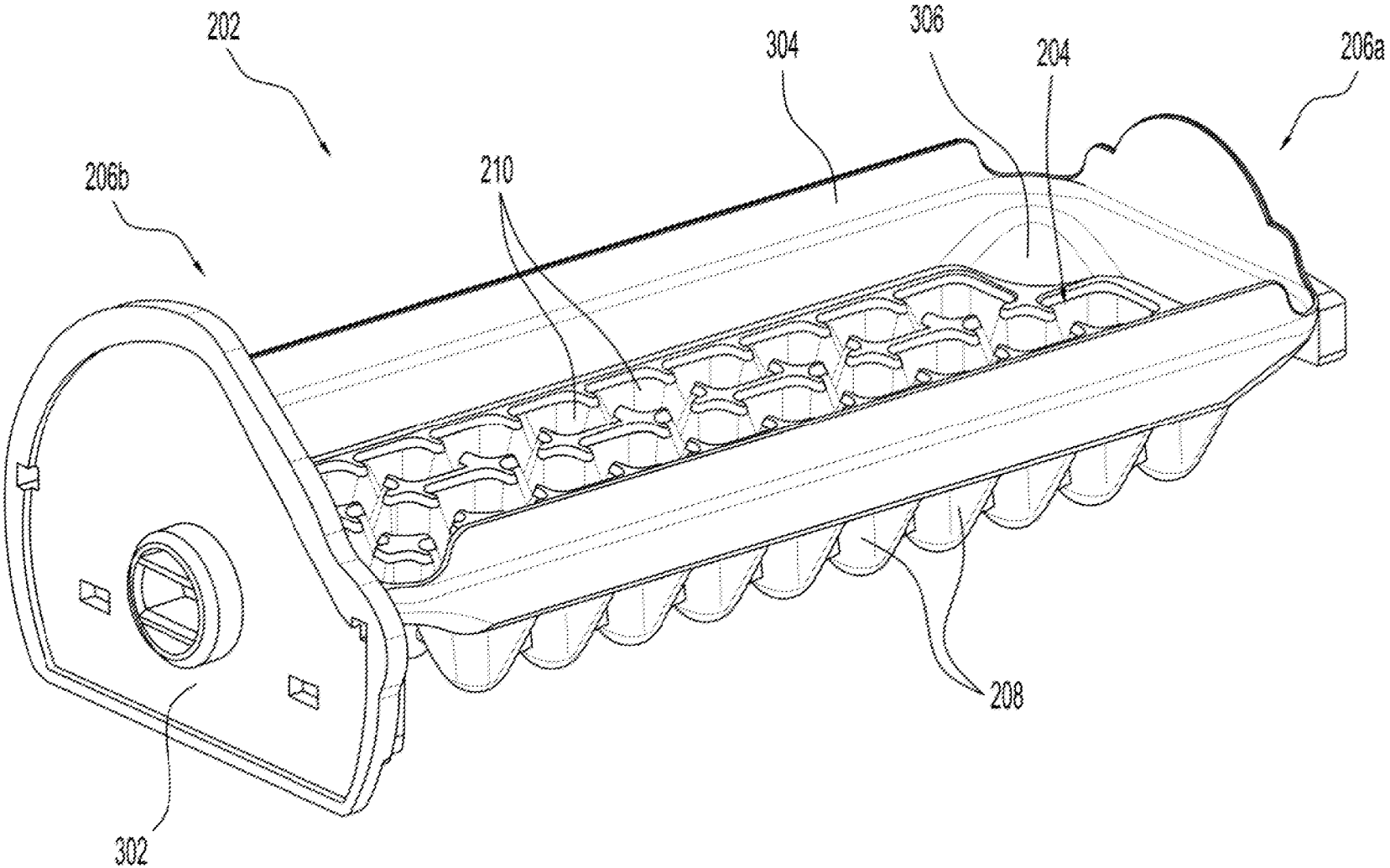
FIG. 3 depicts a perspective view of an example of a twistable ice cube tray with slanted bridging according to some embodiments of the present disclosure.

FIG. 3 depicts a perspective view of an example of the twistable ice cube tray 202 with slanted bridging according to some embodiments of the present disclosure. The twistable ice cube tray 202 can be filled with water at fill point 204. Slanted bridges between ice cavities 208 can allow the water to propagate from the first end 206*a* to the second end 206*b*. The water can then form into ice cubes 210. The twistable ice cube tray 202 can include a cam 302 at the second end 206*b* that can couple to the gear system of the automatic ice-making system 200 of FIG. 2. The gear system can cause the cam 302 to rotate, which can twist the second end 206 of the twistable ice cube tray 202 to expel the ice cubes 210. The twistable ice cube tray 202 can also include a splash guard 304 that can prevent water from splashing over the edges of the twistable ice cube tray 202 during water filling.

In some cases, reducing the size of the ice cavities 208 can put additional stress on the twistable ice cube tray 202 that can increase the likelihood of cracking, particularly in the corners of the twistable ice cube tray 202. This is because the corners can be either stretched apart or compressed (depending on the direction of the twist) to expel ice cubes 210. Therefore, in some examples the twistable ice cube tray 202 can include angled corners 306 instead of corner ice cavities. The corners 306 can be angled upwards from the top surface of the ice cavities 208. Including the angled corners 306 can more evenly spread the twisting stress along the front and back of the twistable ice cube tray 202. Although some potential ice cavities (e.g., 4) are replaced with the angled corners 306, this geometry can reduce the likelihood of cracking and extend the lifespan of the twistable ice cube tray 202.

Figure 4:
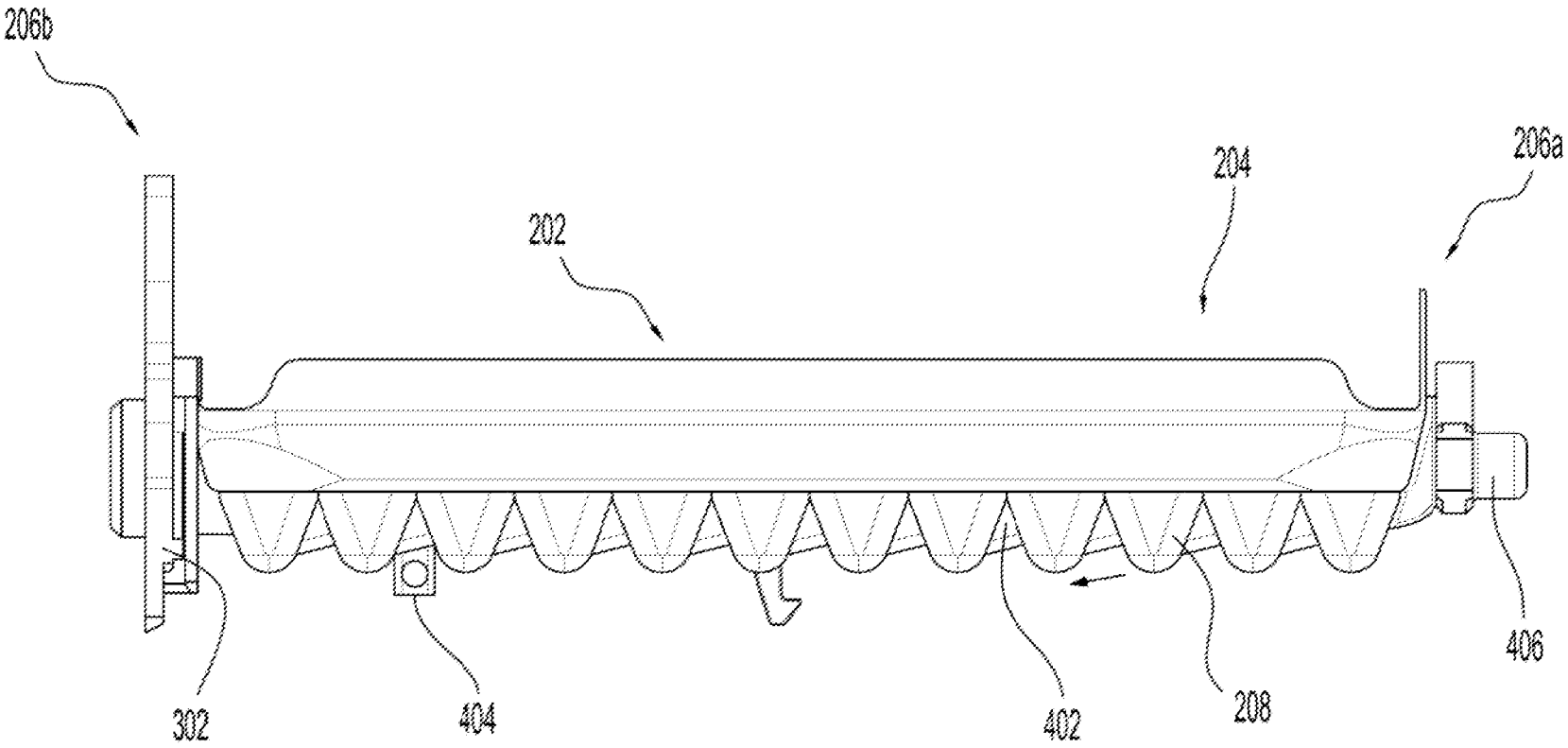
FIG. 4 depicts a side view of an example of a twistable ice cube tray with slanted bridging according to some embodiments of the present disclosure.

FIG. 4 depicts a side view of an example of the twistable ice cube tray 202 with slanted bridging according to some embodiments of the present disclosure. The twistable ice cube tray 202 can include slanted bridges 402 that can transfer water filled at a fill point (e.g., a first set of ice cavities at the first end 206*a* of the twistable ice cube tray 202) to the rest of the twistable ice cube tray 202 (e.g., to a second set of ice cavities at the second end 206*b* of the twistable ice cube tray 202 opposite the first end 206*a*). The slanted bridges 402 can lead downward from the fill point 204. Despite the small mass (e.g., 1.5 g) of water placed in each ice cavity 208, the slanted bridges 402 can allow the surface tension of the water to be broken. Thus, the water can flow between each adjacent ice cavity 208.

Figure 5:
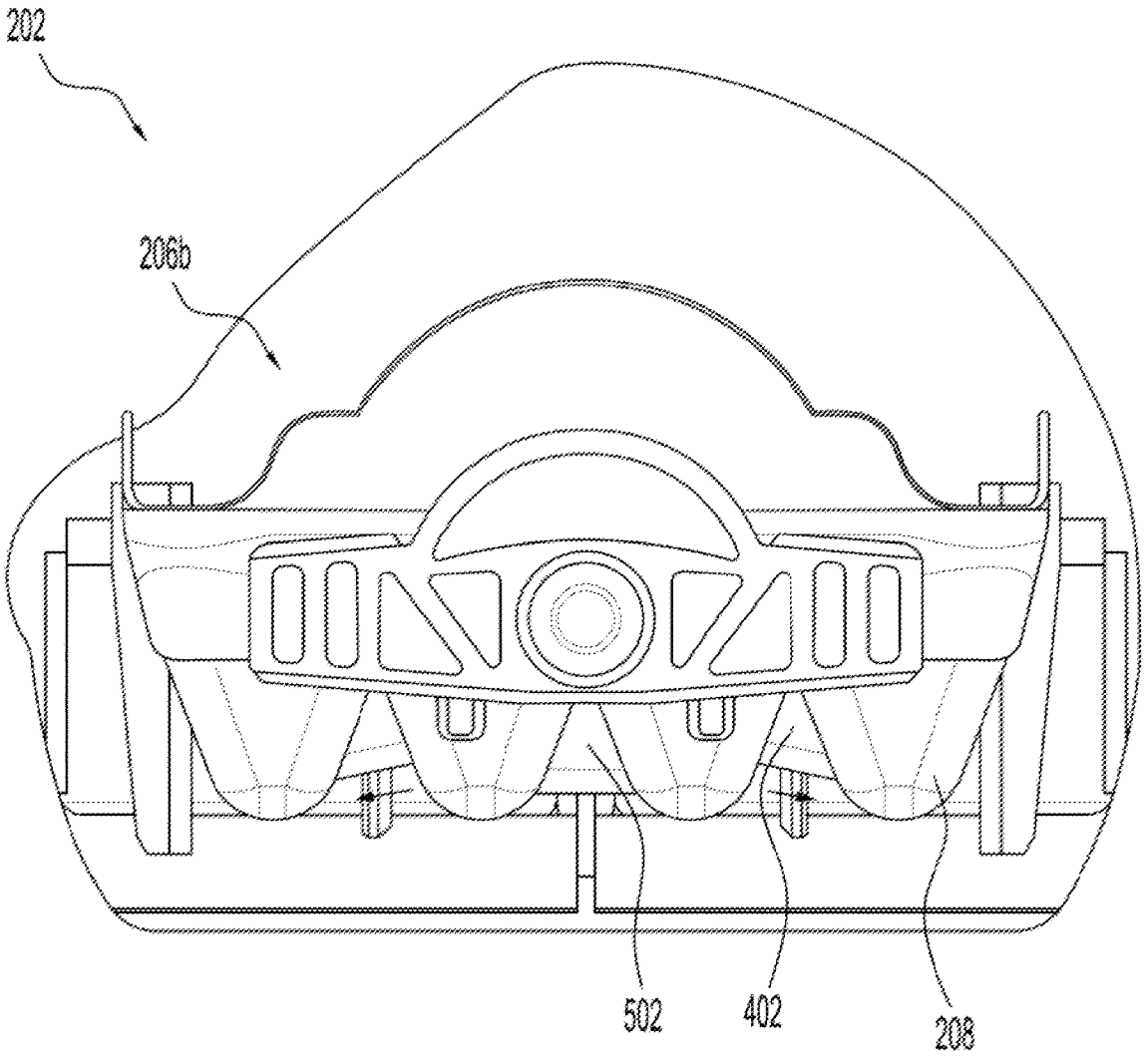
FIG. 5 depicts a front view of an example of a twistable ice cube tray with slanted bridging according to some embodiments of the present disclosure.

In some examples, the ice cavities 208 may have a slanted bridge 402 between some or all adjacent ice cavities 208. As illustrated in FIG. 5, which depicts a front view of the second end 206*b* of the twistable ice cube tray 202, the slanted bridges 402 can lead downward from the middle to the sides of the tray. This can allow the water to propagate towards the second end 206*b* of the twistable ice cube tray 202 as well as the edges. In some examples, some bridges in the middle of the twistable ice cube tray 202, such as bridge 502, may be horizontal rather than slanted.

Referring back to FIG. 4, the twistable ice cube tray 202 can include a cam 302 that can be turned to rotate the second end 206*b* of the twistable ice cube tray 202. The twistable ice cube tray 202 can also include a stop bar 406 that can prevent (e.g., partially or entirely) the first end 206*a* of the twistable ice cube tray 202 from rotating. Preventing rotation on the first end 206*a* while the second end 206*b* is rotated can cause the twistable ice cube tray 202 to twist, break the pieces of ice connecting the ice cubes, and expel the ice cubes from the twistable ice cube tray 202. The channel formed by the slanted bridges 402 (e.g., through which water propagates to adjacent ice cavities 208) can be relatively small compared to the size of the ice cubes formed in the ice cavities 208. Therefore, when the twistable ice cube tray 202 is twisted to expel the ice cubes, the twisting motion can break the small amount of ice formed in the slanted bridges 402. This can separate the connection between adjacent ice cubes.

The slanted bridges 402 may not extend down to a bottom of an adjacent ice cavity 208. This can ensure that the ice formed between adjacent ice cubes in the channel can be easily broken to separate ice cubes when the twistable ice cube tray 202 is twisted. Further, the slanted bridges 402 allow the ice cavities 208 to fill with water without creating a slab of ice over the top of the ice cavities 208. A slab of ice caused by overfilling the ice cavities 208 may be difficult or impossible to break via twisting of the twistable ice cube tray 202. In some examples, ice slabs can cause increased strain on the twistable ice cube tray 202. The volume of water can expand by about 9% in a phase change from liquid to ice, so in some cases ice cavities 208 that are not initially overfilled may expand to create a slab when frozen. Using the slanted bridges 402 can allow the water to evenly propagate to ice cavities 208 across the twistable ice cube tray 202 without causing overfill.

The ice cubes may be expelled from the twistable ice cube tray 202 when a thermistor 404 detects a temperature of the ice cavities 208 indicating that the water inside has experienced a phase change from liquid water to ice. For example, the automatic ice-making system 200 of FIG. 2 may cause the twistable ice cube tray 202 to twist and expel ice cubes when the thermistor detects a freezing temperature. The thermistor 404 can be positioned beneath the twistable ice cube tray 202 at the second end 206*b* in contact with ice cavities 208.

Figure 6:
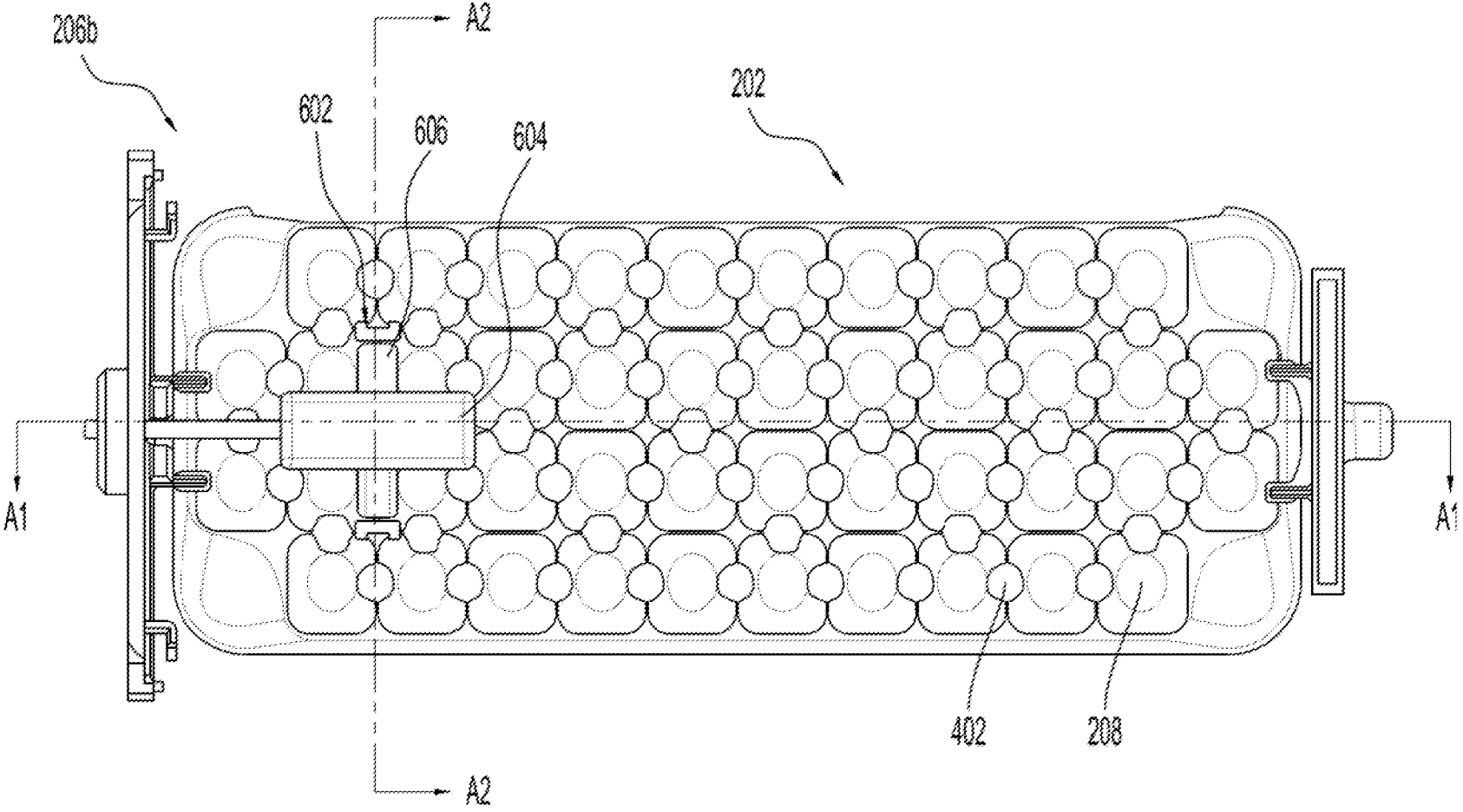
FIG. 6 depicts a bottom view of an example of a twistable ice cube tray and a thermistor system according to some embodiments of the present disclosure.

FIG. 6 depicts a bottom view of an example of a twistable ice cube tray 202 and a thermistor system 602 according to some embodiments of the present disclosure. The thermistor system 602 can be attached to a bottom surface of the twistable ice cube tray 202 at the second end 206*b*. The ice cavities 208 and slanted bridges 402 at the area of attachment can have a different geometry than other ice cavities 208 and slanted bridges 402 in the twistable ice cube tray 202. For example, the geometry of the bottom surface of this set (e.g., a third set) of ice cavities can be a same geometry as a top surface of the thermistor system 602. The thermistor system 602 can be positioned between ice cavities 208 in the third set and can include a thermistor cover 604 and one or more coupling elements 606 that can couple to slanted bridges 402 adjacent to the third set of ice cavities.

Figure 7:
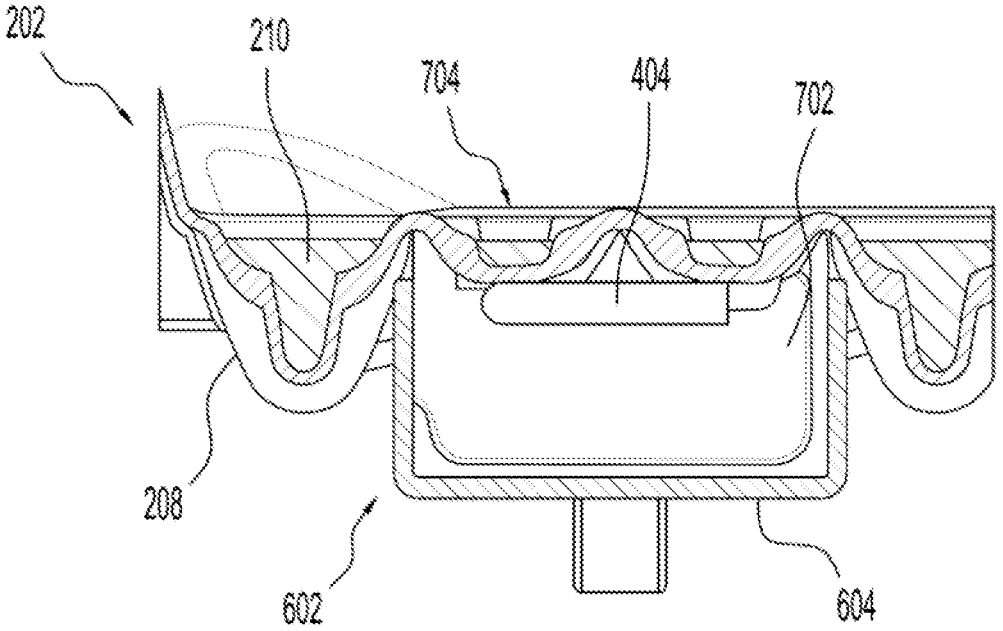
FIG. 7 depicts a cross-sectional view of an example of a twistable ice cube tray and a thermistor system according to some embodiments of the present disclosure.

FIG. 7 depicts a cross-sectional view of an example of a twistable ice cube tray 202 and a thermistor system 602 according to some embodiments of the present disclosure. The cross-sectional view depicted in FIG. 7 can be across the line A1 depicted in FIG. 6. The thermistor system 602 can include a thermistor 404 that can detect temperature, a thermistor insulator 702 to insulate the thermistor 404, and a thermistor cover 604 surrounding the thermistor 404 and the thermistor insulator 702.

The thermistor system 602 can be attached to the twistable ice cube tray 202 beneath a third set of ice cavities 704. The geometry of the bottom surface of the third set of ice cavities 704 can match the geometry of the top surface of the thermistor system 602. This can allow the thermistor 404 to have increased contact with the bottom surface of the twistable ice cube tray 202. To accommodate the thermistor 404, the cavities defined by the second and third set of ice cavities 704 may have a first depth that is smaller than a second depth of cavities defined by other ice cavities 208. Although the first depth is smaller than the second depth, the first depth may be deep enough (e.g., below a fill level of the twistable ice cube tray 202) to form an ice cube 210 with a freezing temperature that can be detected by the thermistor 404. Further, in some examples the first depth of the third set of ice cavities 704 can match a diameter of the thermistor 404. This can maximize contact between the thermistor 404 and the third set of ice cavities 704.

The thermistor insulator 702 can surround and insulate the thermistor 404. This can protect the thermistor 404 from air flow beneath the twistable ice cube tray 202, such as from a fan in the automatic ice-making system 200 of FIG. 2. The top of the thermistor insulator 702 can be molded to fit the bottom surface of the third set of ice cavities 704. In some examples, the thermistor 404 may have a cylindrical shape. The same geometry between the top surface of the thermistor system 602 and the bottom surface of the third set of ice cavities 704 can include this cylindrical shape.

Figure 8:
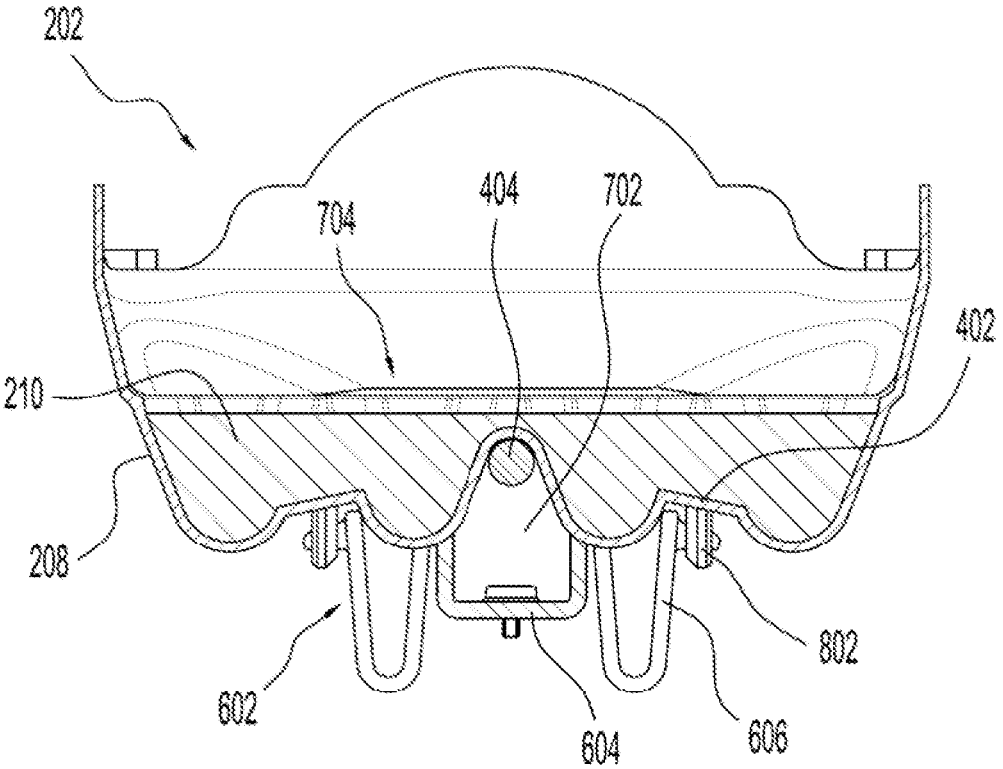
FIG. 8 depicts another cross-sectional view of an example of a twistable ice cube tray and a thermistor system according to some embodiments of the present disclosure.

This is illustrated in FIG. 8, which depicts another cross-sectional view of an example of a twistable ice cube tray 202 and a thermistor system 602 according to some embodiments of the present disclosure. The cross-sectional view depicted in FIG. 8 can be across the line A2 depicted in FIG. 6. The round shape of the thermistor 404 can match the round shape of the underside of the third set of ice cavities 704 to maximize contact between the thermistor 404 and the twistable ice cube tray 202.

The thermistor system 602 can include a thermistor cover 604 that can hold the thermistor insulator 702 and thermistor 404 against the underside of the twistable ice cube tray 202. The thermistor cover 604 can include one or more (e.g., two) coupling elements 606 that can couple to slanted bridges 402 adjacent to the third set of ice cavities 704. For example, the slanted bridges 402 may include a protrusion 802 that extends in a downward direction from the bottom of the twistable ice cube tray 202. The coupling element 606 can be coupled to (e.g., bolted or screwed onto) the protrusion 802, thus securely attaching the thermistor system 602 to the twistable ice cube tray 202. Coupling the thermistor system 602 to the twistable ice cube tray 202 in this way can maximize contact between the thermistor 404 and the third set of ice cavities 704 without significantly increasing the strain on the twistable ice cube tray 202. Thus, the twistable ice cube tray 202 may twist to eject ice cubes 210 without the thermistor system 602 causing the twistable ice cube tray 202 to crack.

Figure 9:
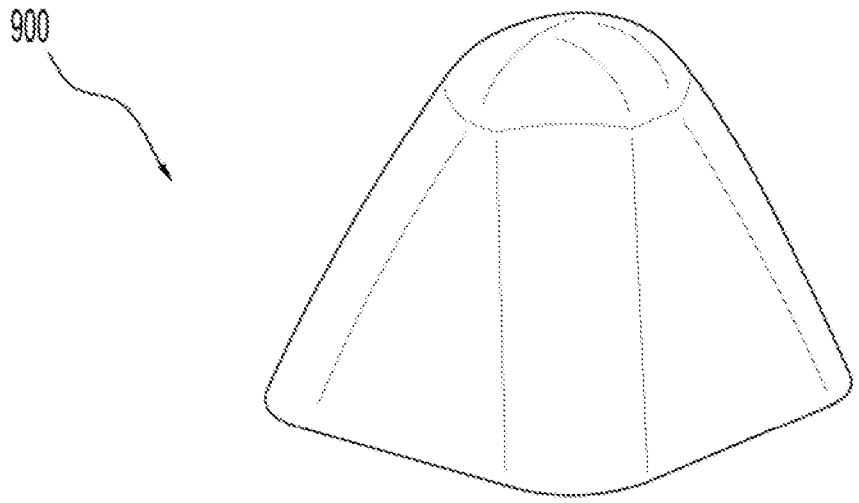
FIG. 9 depicts an example of an ice cube in a pyramid shape according to some embodiments of the present disclosure.

Although the twistable ice cube tray 202 of FIGS. 2-8 are depicted as having 44 ice cavities 208, in other examples any number and arrangement of ice cavities 208 with slanted bridging between some or all adjacent ice cavities 208 may be used. Further, although the ice cubes 210 produced by the twistable ice cube tray 202 are depicted in FIGS. 2-8 as having a pyramid shape, such as the pyramid-shaped ice 900 depicted in FIG. 9, other ice cavities with different shapes can be used to produce different types of ice cubes.

Figure 10:
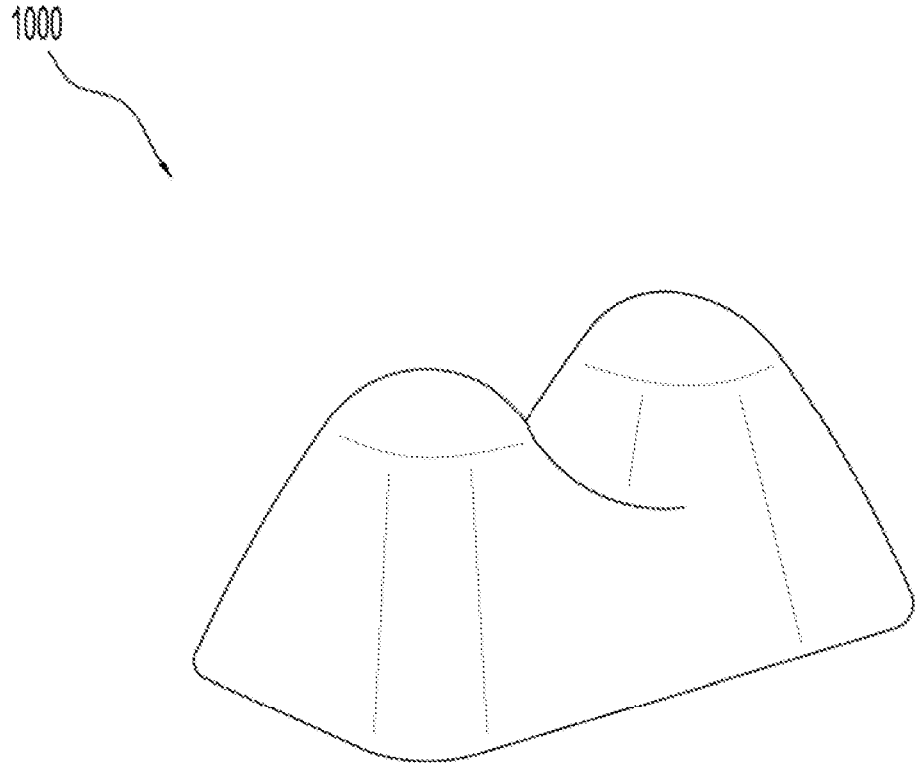
FIG. 10 depicts an example of an ice cube in an accordion shape according to some embodiments of the present disclosure.
Figure 11:
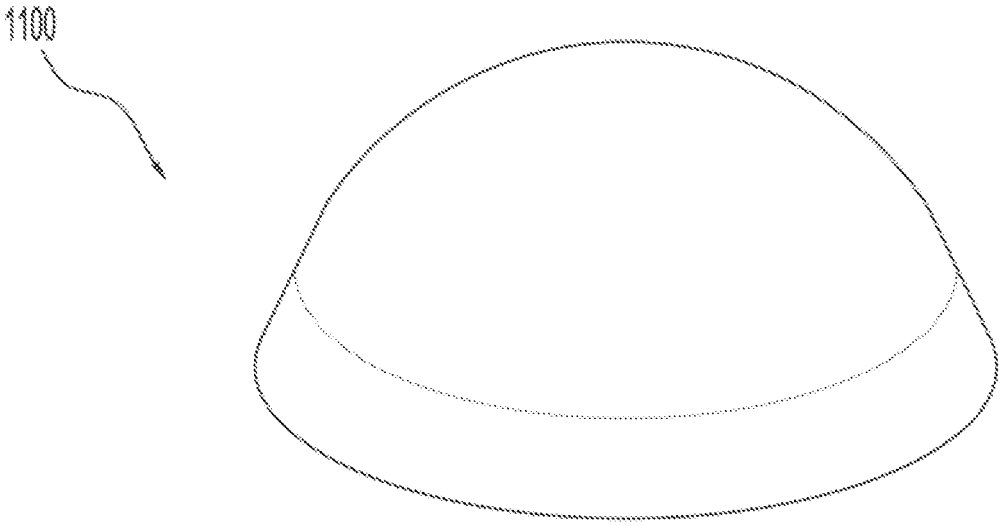
FIG. 11 depicts an example of an ice cube in a button shape according to some embodiments of the present disclosure.
Figure 12:
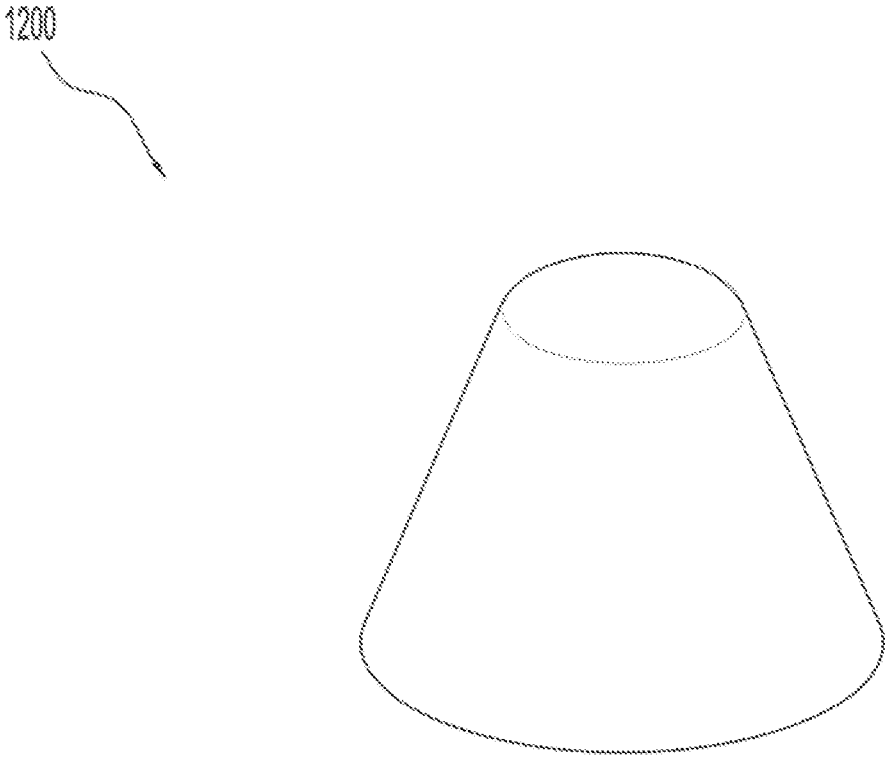
FIG. 12 depicts an example of an ice cube in a conical shape according to some embodiments of the present disclosure.
Figure 13:
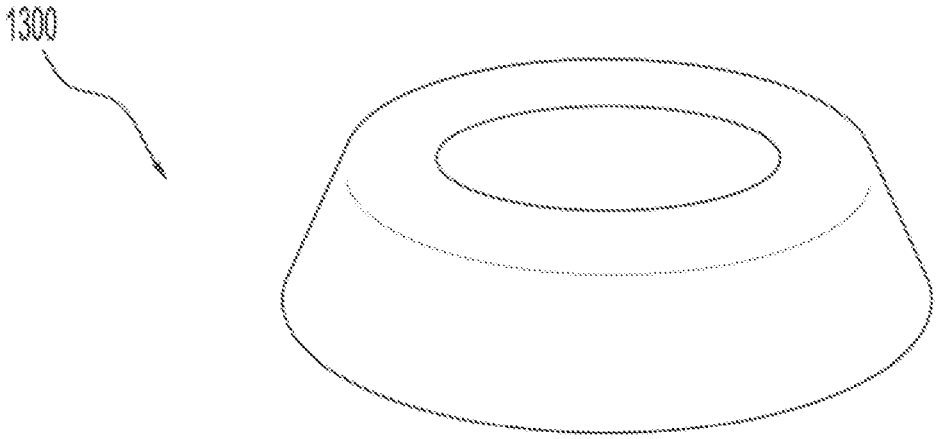
FIG. 13 depicts an example of an ice cube in a round dimple shape according to some embodiments of the present disclosure.
Figure 14:
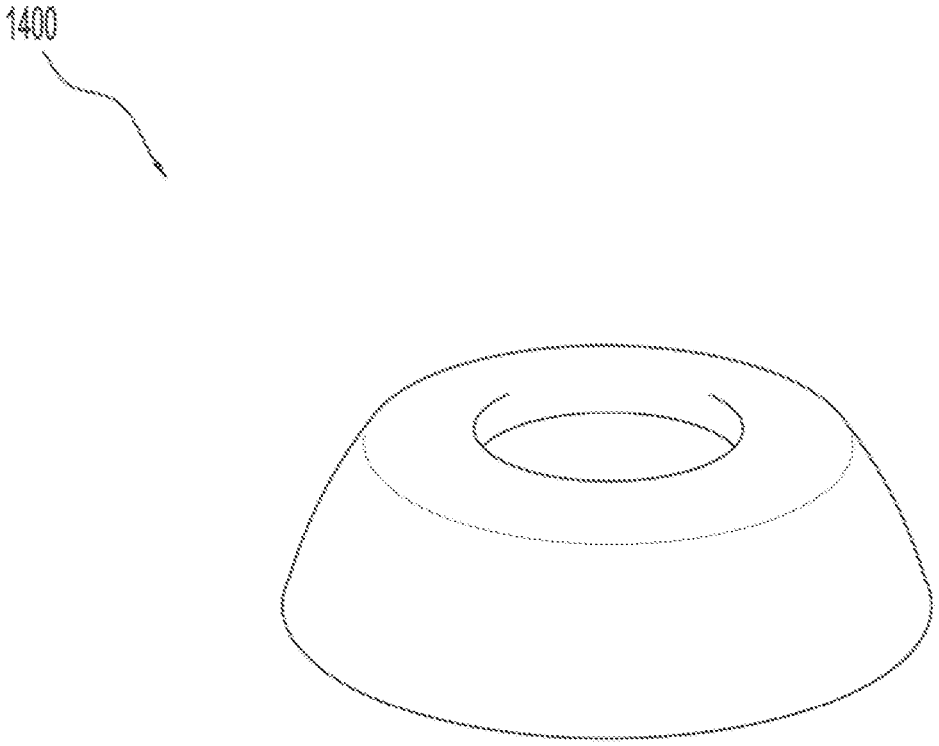
FIG. 14 depicts an example of an ice cube in a donut shape according to some embodiments of the present disclosure.
Figure 15:
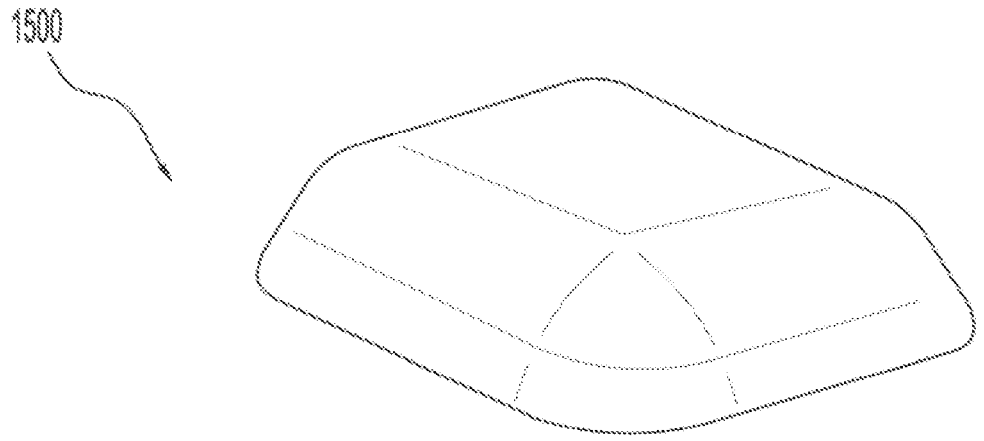
FIG. 15 depicts an example of an ice tray cavity in a square shape according to some embodiments of the present disclosure.
Figure 16:
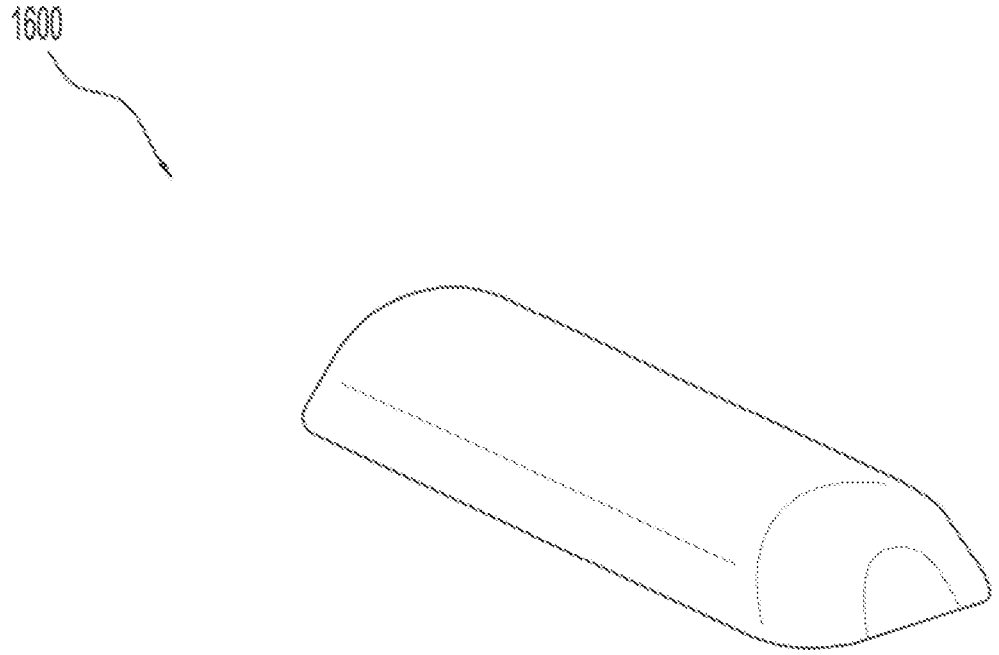
FIG. 16 depicts an example of an ice tray cavity in a thin bar shape according to some embodiments of the present disclosure.

Examples of other types of ice cube shapes can include the accordion-shaped ice 1000 depicted in FIG. 10, the button-shaped ice 1100 depicted in FIG. 11, the conical-shaped ice 1200 depicted in FIG. 12, the round dimple-shaped ice 1300 depicted in FIG. 13, the donut-shaped ice 1400 depicted in FIG. 14, the square-shaped ice 1500 depicted in FIG. 15, the thin bar-shaped ice 1600 depicted in FIG. 16, or any other suitable shape. Each of the ice cubes depicted in FIGS. 9-16 and produced by a twistable ice cube tray as described herein may have a mass of up to 1.5 g. Although each shape of ice cube may have the same mass and volume, the differing dimensions of various shapes of ice cubes may produce different ice characteristics such as chewability or melting time. Additionally, twistable ice cube trays with ice cavities shaped to produce such ice cubes may include slanted bridging between adjacent ice cavities with a depth that can break a surface tension of water in the ice cavities.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A refrigeration appliance comprising:

a cabinet defining a freezer space;

an automatic ice-making system positioned in the cabinet and comprising:

a water-filling system;

a twistable ice cube tray configured to receive water from the water-filling system at a first end of the twistable ice cube tray, the twistable ice cube tray comprising:

a plurality of ice cavities of a size that enables freezing the water into a plurality of ice cubes each having a mass of up to 1.5 grams and arranged along the twistable ice cube tray in a first direction that is parallel to a centerline of the twistable ice cube tray that extends from the first end to an opposite second end, a first plurality of slanted bridges, each slanted bridge of the first plurality of slanted bridges positioned between adjacent ice cavities of the plurality of ice cavities in the first direction and sloping downward from the first end toward the second end to facilitate transfer of the water from a first set of ice cavities of the plurality of ice cavities at the first end to a second set of ice cavities of the plurality of ice cavities at the second end of the twistable ice cube tray by enabling a leading edge of the water in a given ice cavity to break its surface tension and flow into a next adjacent ice cavity in the first direction, and a thermistor system coupled to the twistable ice cube tray and configured to detect a temperature of the water in the plurality of ice cavities, the thermistor system comprising a thermistor positioned between adjacent ice cavities of the twistable ice cube tray and a thermistor cover that is configured to hold the thermistor against a bottom surface of the twistable ice cube tray and is coupled to a downwardly extending protrusion of each of a pair of slanted bridges of the first plurality of slanted bridges that reside on opposite sides of the centerline and are adjacent to the thermistor.

2. The refrigeration appliance of claim 1, wherein:

a top surface of the thermistor system has a same geometry as a bottom surface of the second set of ice cavities and a third set of ice cavities of the plurality of ice cavities at the second end of the twistable ice cube tray;

the thermistor is positioned between adjacent ice cavities of the second set of ice cavities and the third set of ice cavities;

the pair of slanted bridges are adjacent to the second set of ice cavities and the third set of ice cavities; and the thermistor cover is configured to also hold a thermistor insulator against the bottom surface of the twistable ice cube tray.

3. The refrigeration appliance of claim 2, wherein a cavity defined by each of the second set of ice cavities and the third set of ice cavities has a first depth that is smaller than a second depth of other cavities defined by other ice cavities in the plurality of ice cavities.

4. The refrigeration appliance of claim 2, wherein the thermistor has a cylindrical shape, and wherein the bottom surface of the second set of ice cavities and the third set of ice cavities of the twistable ice cube tray has the same geometry comprising the cylindrical shape of the thermistor.

5. The refrigeration appliance of claim 1, wherein each of the plurality of ice cavities are configured to produce an ice cube having at least one of an accordion shape, a button shape, a conical shape, a round dimple shape, a donut shape, a square shape, a pyramid shape, or a bar shape.

6. The refrigeration appliance of claim 1, wherein the twistable ice cube tray further comprises:

a cam at the second end of the twistable ice cube tray and configured to rotate the second end of the twistable ice cube tray; and a stop bar at the first end of the twistable ice cube tray and configured to prevent a rotation of the first end of the twistable ice cube tray to cause the twistable ice cube tray to twist and expel the plurality of ice cubes.

7. The refrigeration appliance of claim 1, wherein the plurality of ice cavities of the twistable ice cube tray are further arranged in a second direction that is perpendicular to the first direction and extends from a first edge to an opposite second edge of the twistable ice cube tray, the plurality of ice cavities are equally distributed on opposite sides of the centerline, and the twistable ice cube tray further comprises:

a second plurality of slanted bridges, each slanted bridge of the second plurality of slanted bridges positioned between adjacent ice cavities of the plurality of ice cavities on opposite sides of the centerline of the twistable ice cube tray and in the second direction, each of the second plurality of slanted bridges sloping downward toward the first edge or the second edge of the twistable ice cube tray to facilitate transfer of the water from ice cavities located nearer the centerline of the twistable ice cube tray to ice cavities located nearer the opposite edges of the twistable ice cube tray by enabling a leading edge of the water in a given ice cavity to break its surface tension and flow into a next adjacent ice cavity in the second direction; and a plurality of non-slanted bridges, each non-slanted bridge of the plurality of non-slanted bridges extending in the second direction across the centerline of the twistable ice cube tray and connecting adjacent ice cavities of the plurality of ice cavities that are not connected by a slanted bridge of the second plurality of slanted bridges to help balance a level of the water within the ice cavities.

8. The refrigeration appliance of claim 1, wherein edges of the twistable ice cube tray are upwardly angled at each corner thereof to more evenly distribute a twisting stress along a front and back of the twistable ice cube tray.

9. A twistable ice cube tray for a refrigeration appliance, comprising:

a plurality of ice cavities of a size that enables freezing water into a plurality of ice cubes each having a mass of up to 1.5 grams and arranged along the twistable ice cube tray in a first direction that is parallel to a centerline of the twistable ice cube tray that extends from a first, water filling end, to an opposite second end;

a first plurality of slanted bridges, each slanted bridge of the first plurality of slanted bridges positioned between adjacent ice cavities of the plurality of ice cavities in the first direction and sloping downward from the first end toward the second end to facilitate transfer of the water received from a water-filling system at a first set of ice cavities of the plurality of ice cavities at the first end of the twistable ice cube tray to a second set of ice cavities of the plurality of ice cavities at the second end of the twistable ice cube tray by enabling a leading edge of the water in a given ice cavity to break its surface tension and flow into a next adjacent ice cavity in the first direction; and a thermistor cover that is configured to hold a thermistor against a bottom surface of the twistable ice cube tray and is couplable to a downwardly extending protrusion of each of a pair of slanted bridges of the first plurality of slanted bridges that reside on opposite sides of the centerline and are adjacent to a desired location of the thermistor.

10. The twistable ice cube tray of claim 9, wherein:

the thermistor cover is part of a thermistor system;

a top surface of the thermistor system is coupled to a bottom of the twistable ice cube tray and has a same geometry as a bottom surface of the second set of ice cavities and a third set of ice cavities of the plurality of ice cavities at the second end of the twistable ice cube tray; and the thermistor system further comprises a thermistor positioned between adjacent ice cavities of the third set of ice cavities;

the pair of slanted bridges are adjacent to the second set of ice cavities and the third set of ice cavities; and the thermistor cover is configured to also hold a thermistor insulator against the bottom surface of the twistable ice cube tray.

11. The twistable ice cube tray of claim 10, wherein a cavity defined by each of the second set of ice cavities and the third set of ice cavities has a first depth that is smaller than a second depth of other cavities defined by other ice cavities in the plurality of ice cavities.

12. The twistable ice cube tray of claim 10, wherein the thermistor has a cylindrical shape, and wherein the bottom surface of the second set of ice cavities and the third set of ice cavities of the twistable ice cube tray has the same geometry comprising the cylindrical shape of the thermistor.

13. The twistable ice cube tray of claim 9, wherein each of the plurality of ice cavities is configured to produce an ice cube having at least one of an accordion shape, a button shape, a conical shape, a round dimple shape, a donut shape, a square shape, a pyramid shape, or a bar shape.

14. The twistable ice cube tray of claim 9, further comprising:

a cam at the second end of the twistable ice cube tray and configured to rotate the second end of the twistable ice cube tray; and a stop bar at the first end of the twistable ice cube tray and configured to prevent a rotation of the first end of the twistable ice cube tray to cause the twistable ice cube tray to twist and expel the plurality of ice cubes.

15. The twistable ice cube tray of claim 9, wherein the plurality of ice cavities are further arranged in a second direction that is perpendicular to the first direction and extends from a first edge to an opposite second edge of the twistable ice cube tray, the plurality of ice cavities are equally distributed on opposite sides of the centerline, and the twistable ice cube tray further comprises:

a second plurality of slanted bridges, each slanted bridge of the second plurality of slanted bridges positioned between adjacent ice cavities of the plurality of ice cavities on opposite sides of the centerline of the twistable ice cube tray and in the second direction, each of the second plurality of slanted bridges sloping downward toward the first edge or the second edge of the twistable ice cube tray to facilitate transfer of the water from ice cavities located nearer the centerline of the twistable ice cube tray to ice cavities located nearer the opposite edges of the twistable ice cube tray by enabling a leading edge of the water in a given ice cavity to break its surface tension and flow into a next adjacent ice cavity in the second direction; and a plurality of non-slanted bridges, each non-slanted bridge of the plurality of non-slanted bridges extending in the second direction across the centerline of the twistable ice cube tray and connecting adjacent ice cavities of the plurality of ice cavities that are not connected by a slanted bridge of the second plurality of slanted bridges to help balance a level of the water within the ice cavities.

16. The twistable ice cube tray of claim 9, wherein edges of the twistable ice cube tray are upwardly angled at each corner thereof to more evenly distribute a twisting stress along a front and back of the twistable ice cube tray.

17. An automatic ice-making system for a refrigeration appliance, comprising:

a water-filling system; and a twistable ice cube tray configured to receive water from the water-filling system at a first end of the twistable ice cube tray, the twistable ice cube tray comprising:

a plurality of ice cavities of a size that enables freezing the water into a plurality of ice cubes each having a mass of up to 1.5 grams and arranged along the twistable ice cube tray in a first direction that is parallel to a centerline of the twistable ice cube tray that extends from the first end to an opposite second end, a first plurality of slanted bridges, each slanted bridge of the first plurality of slanted bridges positioned between adjacent ice cavities of the plurality of ice cavities in the first direction and sloping downward from the first end toward the second end to facilitate transfer of the water from a first set of ice cavities of the plurality of ice cavities at the first end to a second set of ice cavities of the plurality of ice cavities at the second end of the twistable ice cube tray by enabling a leading edge of the water in a given ice cavity to break its surface tension and flow into a next adjacent ice cavity in the first direction; and a thermistor system coupled to the twistable ice cube tray and configured to detect a temperature of the water in the plurality of ice cavities, the thermistor system comprising a thermistor positioned between adjacent ice cavities of the twistable ice cube tray and a thermistor cover that is configured to hold the thermistor against a bottom surface of the twistable ice cube tray and is coupled to a downwardly extending protrusion of each of a pair of slanted bridges of the first plurality of slanted bridges that reside on opposite sides of the centerline and are adjacent to the thermistor.

18. The automatic ice-making system of claim 17, wherein:

a top surface of the thermistor system has a same geometry as a bottom surface of the second set of ice cavities and a third set of ice cavities of the plurality of ice cavities at the second end of the twistable ice cube tray;

the thermistor is positioned between adjacent ice cavities of the second set of ice cavities and the third set of ice cavities;

the pair of slanted bridges are adjacent to the second set of ice cavities and the third set of ice cavities; and the thermistor cover is configured to also hold a thermistor insulator against the bottom surface of the twistable ice cube tray.

19. The automatic ice-making system of claim 18, wherein a cavity defined by each of the second set of ice cavities and the third set of ice cavities has a first depth that is smaller than a second depth of other cavities defined by other ice cavities in the plurality of ice cavities.

20. The automatic ice-making system of claim 17, wherein the plurality of ice cavities of the twistable ice cube tray are further arranged in a second direction that is perpendicular to the first direction and extends from a first edge to an opposite second edge of the twistable ice cube tray, the plurality of ice cavities are equally distributed on opposite sides of the centerline, and the twistable ice cube tray further comprises:

a second plurality of slanted bridges, each slanted bridge of the second plurality of slanted bridges positioned between adjacent ice cavities of the plurality of ice cavities on opposite sides of the centerline of the twistable ice cube tray and in the second direction, each of the second plurality of slanted bridges sloping downward toward the first edge or the second edge of the twistable ice cube tray to facilitate transfer of the water from ice cavities located nearer the centerline of the twistable ice cube tray to ice cavities located nearer the opposite edges of the twistable ice cube tray by enabling a leading edge of the water in a given ice cavity to break its surface tension and flow into a next adjacent ice cavity in the second direction; and a plurality of non-slanted bridges, each non-slanted bridge of the plurality of non-slanted bridges extending in the second direction across the centerline of the twistable ice cube tray and connecting adjacent ice cavities of the plurality of ice cavities that are not connected by a slanted bridge of the second plurality of slanted bridges to help balance a level of the water within the ice cavities.

* * * * *